US007677918B1

(12) United States Patent
Huang et al.

(10) Patent No.: US 7,677,918 B1
(45) Date of Patent: Mar. 16, 2010

(54) CONNECTOR FOR FLEXIBLE PRINTED CIRCUIT BOARD

(75) Inventors: Sheng-Yuan Huang, Tu-Cheng (TW); Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/379,454

(22) Filed: Feb. 23, 2009

(51) Int. Cl.
*H01R 12/24* (2006.01)

(52) U.S. Cl. ..... 439/495; 439/77

(58) Field of Classification Search ..... 439/492, 439/495, 497, 607.22, 607.28, 607.31, 607.49, 439/67, 77, 260
See application file for complete search history.

(56) References Cited

U.S. PATENT DOCUMENTS 6,733,326 B2 * 5/2004 Lee ..... 439/495
6,840,786 B2 * 1/2005 Sato et al. ..... 439/159
7,416,428 B1 * 8/2008 Hung et al. ..... 439/188
7,438,590 B1 * 10/2008 Liang et al. ..... 439/495

* cited by examiner

*Primary Examiner*—Thanh-Tam T Le
(74) *Attorney, Agent, or Firm*—Rosenberg, Klein & Lee

(57) ABSTRACT

A connector adapted for receiving an FPC board therein includes an insulating housing having a base board, a shell pivoted onto the insulating housing and having a top board, a plurality of electric terminals disposed in the base board of the insulating housing for electrically contacting the FPC board, and at least one ground terminal. The top board protrudes downward to form at least one connecting rib capable of electrically abutting against the FPC board. The ground terminal has a base portion fastened in the base board. A contacting portion and a soldering portion extend from two opposite ends of the base portion, respectively. The contacting portion stretches out of a top surface of the base board for being against the top board of the shell and the soldering portion stretches out of the base board.

9 Claims, 3 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to a connector for a flexible printed circuit (FPC hereinafter for simplification) board.

2. The Related Art

Generally, an FPC connector is adapted for receiving an FPC board therein. The FPC connector includes an insulating housing, a plurality of electric terminals disposed in the insulating housing and electrically contacting the FPC board, and a shell pivoted to the insulating housing and capable of holding the FPC board for making the electric terminals and the FPC board connected with each other firmly. At present, the FPC connector mainly transmits low frequency signals or low speed signals.

However, with the development of electronic field, the FPC connector is required to transmit some high-frequency signals or high-speed signals. As a result, some electromagnetic interference signals are inevitably generated. The above-mentioned FPC connector has no the function of shielding electromagnetic interference. Therefore, the electromagnetic interference signals generated by the high-frequency signals or high-speed signals affect the signal transmission between the electric terminals and the FPC board.

SUMMARY OF THE INVENTION

An object of the present invention is to provide an FPC connector having a good function of shielding electromagnetic interference. The connector adapted for receiving an FPC board therein includes an insulating housing having a base board, a shell pivoted onto the insulating housing and having a top board, a plurality of electric terminals disposed in the base board of the insulating housing for electrically contacting the FPC board, and at least one ground terminal. The top board protrudes downward to form at least one connecting rib capable of electrically abutting against the FPC board. The ground terminal has a base portion fastened in the base board. A contacting portion and a soldering portion extend from two opposite ends of the base portion, respectively. The contacting portion stretches out of a top surface of the base board for being against the top board of the shell and the soldering portion stretches out of the base board.

As described above, the FPC connector of the present invention is designed to make the contacting portion of the ground terminal electrically abut against the top board of the shell and the connecting rib of the shell electrically abut against the FPC board. Therefore, when the FPC connector transmits high-frequency signals or high-speed signals, the electromagnetic interference signals generated between the electric terminals and the FPC board can be completely dispersed out by means of the shell and the ground terminals. So the FPC connector of the present invention has a good effectiveness of shielding electromagnetic interference and can ensure a steady signal transmission between the electric terminals and the FPC board.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
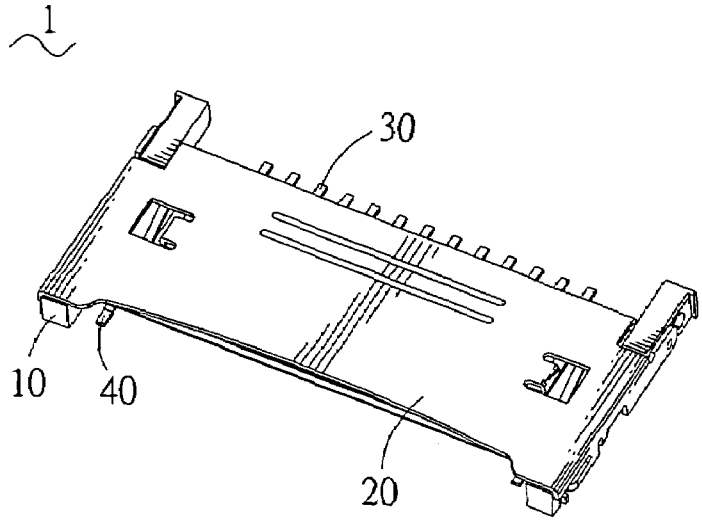
FIG. 1 is a perspective view of an FPC connector in accordance with the present invention.
Figure 4:
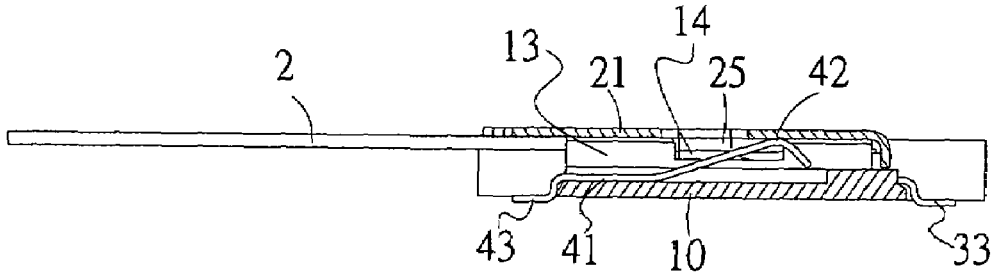
FIG. 4 is a cross-sectional view of the FPC connector with an FPC board therein.
Figure 5:
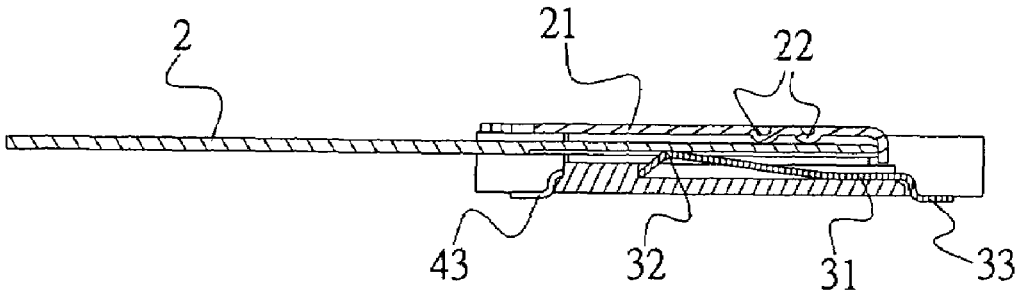
FIG. 5 is another cross-sectional view of the FPC connector with the FPC board therein.

Referring to FIG. 1, FIG. 4 and FIG. 5, an FPC connector 1 in accordance with the present invention includes an insulating housing 10, a shell 20 engaged with the insulating housing 10, a plurality of electric terminals 30 and two ground terminals 40 disposed in the insulating housing 10 respectively.

Figure 2:
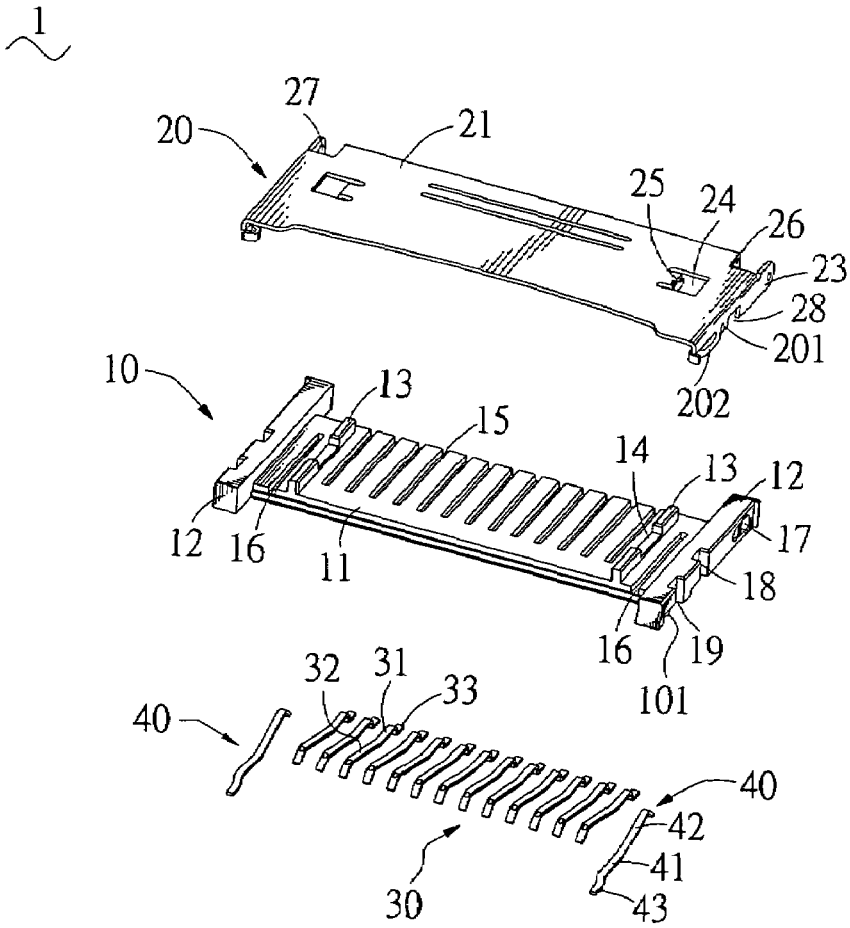
FIG. 2 is an exploded view of the FPC connector of FIG. 1.
Figure 6:
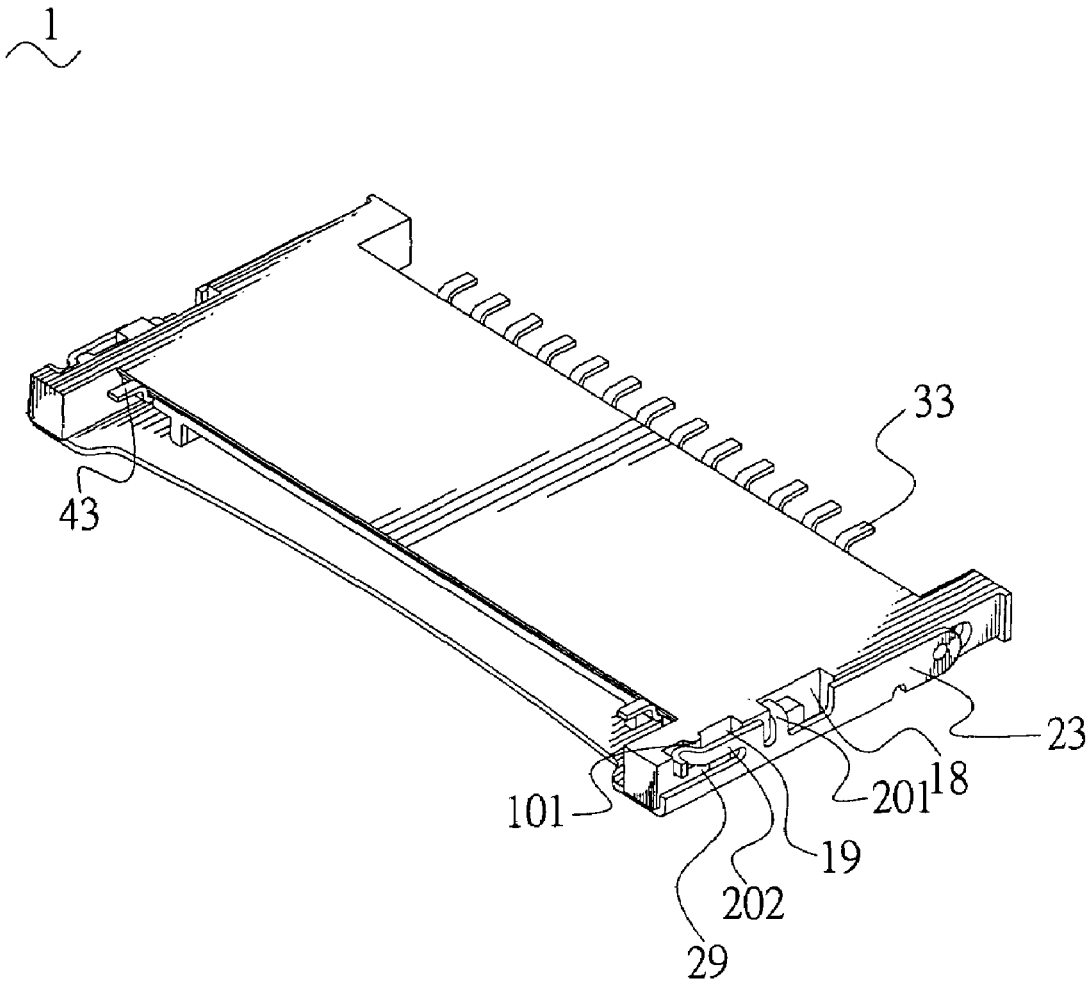
FIG. 6 is another angle perspective view of the FPC connector of FIG. 1.

Referring to FIG. 2 and FIG. 6, the insulating housing 10 has a rectangular base board 11 disposed levelly. Two opposite ends of the base board 11 extend upward to form a pair of sidewalls 12 each extending longitudinally. A top surface of the base board 11 protrudes upward to form two separating boards 13 spaced away from each other and adjacent to the corresponding sidewalls 12. A middle of each of the separating boards 13 defines an inserting notch 14 passing therethrough. The top surface of the base board 11 defines a plurality of receiving cavities 15 arranged at regular intervals along a longwise direction thereof between the separating boards 13 and each extending longitudinally to penetrate through a rear edge of the base board 11. The top surface of the base board 11 further defines two fixing passageways 16 each extending longitudinally to pass through a front edge of the base board 11 and located between the separating board 13 and the corresponding sidewall 12. An outside surface of each of the sidewalls 12 defines a pivoting groove 17 at a rear thereof, an L-shaped first locking fillister 18 at a middle thereof and an L-shaped second locking fillister 19 similar to the first locking fillister 18 at a front thereof. A substantial middle of a level part of each of the second locking fillisters 19 defines a semi-pillared preventing bump 101 extending vertically therein.

Figure 3:
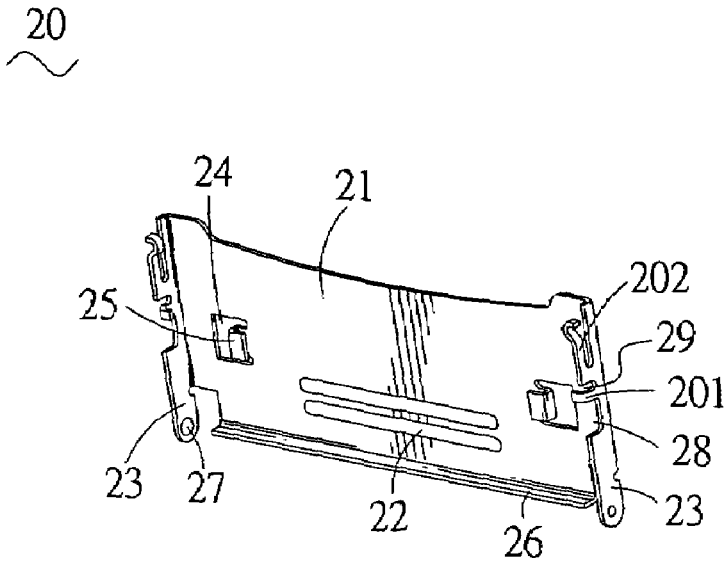
FIG. 3 is a perspective view of a shell of the FPC connector of FIG. 1.

Referring to FIG. 2, FIG. 3 and FIG. 6, the shell 20 has a rectangular top board 21 disposed levelly. A middle of a rear of the top board 21 protrudes downward to form two connecting ribs 22 spaced from each other and each extending longwise. Two opposite ends of the top board 21 extend downward to form a pair of sideboards 23. A middle of each of two sides of the top board 21 defines a window 24 adjacent to the corresponding sideboard 23. Two inner edges of the two windows 24 respectively far away from the corresponding sideboards 23 extend oppositely, then are bent downward and extend face-to-face to form a pair of fixing portions 25. A rear edge of the top board 21 extends downward to form a preventing board 26. A rear end of each of the sideboards 23 protrudes inward to form a pivoting lump 27, a middle thereof defines a first opening 28 and a front thereof defines a second opening 29. A top edge of the first opening 28 extends downward and then is bent inward to form a hook 201. A rear edge of the second opening 29 extends forward and then is arched inward to form a buckling portion 202.

Referring to FIG. 2, each of the electric terminals 30 has a first base portion 31 extending longitudinally. One end of the first base portion 31 extends forward and inclines upward, and then is bent downward to form a first contacting portion 32. The other end of the first base portion 31 is bent downward and then extends rearward to form a first soldering portion 33. Each of the ground terminals 40 is similar to the electric terminal 30 and has a second base portion 41 extending longitudinally, a second contacting portion 42 which extends rearward and inclines upward, and then is bent downward from one end of the second base portion 41, and a second soldering portion 43 which is bent downward and then extends forward from the other end of the second base portion 41.

Referring to FIG. 1, FIG. 4, FIG. 5 and FIG. 6, in assembly, the first base portion 31 of each of the electric terminals 30 is fastened in the corresponding receiving cavity 15 of the insulating housing 10. The first contacting portion 32 stretches out of the top surface of the base board 11 and the first soldering portion 33 stretches out of the rear edge of the base board 11 for being soldered to a printed circuit board (not shown). The second base portion 41 of each of the ground terminals 40 is fastened in the corresponding fixing passageway 16. The second contacting portion 42 stretches out of the top surface of the base board 11 and the second soldering portion 43 stretches out of the front edge of the base board 11 for being soldered to the printed circuit board. The pivoting lumps 27 of the shell 20 are pivoted in the corresponding pivoting grooves 17 of the insulating housing 10 so as to make the shell 20 pivoted to the insulating housing 10.

In use, when an FPC board 2 is to be inserted into the FPC connector 1, the shell 20 is opened rearward and then the FPC board 2 is clipped between the two fixing portions 25 and held by the preventing board 26. At the same time, the connecting ribs 22 electrically abut against the FPC board 2. Next, the shell 20 is turned forward to be covered onto the insulating housing 10. The fixing portion 25 of the shell 20 is inserted in the corresponding inserting notch 14 and the FPC board 2 is located between the two separating boards 13. The first contacting portion 32 of the electric terminal 30 electrically contacts the FPC board 2 and the second contacting portion 42 of the ground terminal 40 electrically abuts against the top board 21 of the shell 20. Simultaneously, the hook 201 of the shell 20 is buckled into a level part of the corresponding first locking fillister 18 and the buckling portion 202 is buckled into the level part of the corresponding second locking fillister 19 and held by the corresponding preventing bump 101 so that the shell 20 can be firmly closed on the insulating housing 10.

As described above, the FPC connector 1 of the present invention is designed to make the second contacting portion 42 of the ground terminal 40 electrically abut against the top board 21 of the shell 20 and the connecting rib 22 of the shell 20 electrically abut against the FPC board 2. Therefore, when the FPC connector 1 transmits high-frequency signals or high-speed signals, the electromagnetic interference signals generated between the electric terminals 30 and the FPC board 2 can be completely dispersed out by means of the shell 20 and the ground terminals 40. So the FPC connector 1 of the present invention has a good effectiveness of shielding electromagnetic interference and can ensure a steady signal transmission between the electric terminals 30 and the FPC board 2.

What is claimed is:

1. A connector adapted for receiving a flexible printed circuit board therein, comprising:

an insulating housing having a base board;

a plurality of electric terminals disposed in the base board of the insulating housing for electrically contacting the flexible printed circuit board;

a shell pivoted onto the insulating housing and having a top board, the top board protruding downward to form at least one connecting rib capable of electrically abutting against the flexible printed circuit board; and at least one ground terminal disposed in the insulating housing, the ground terminal having a base portion fastened in the base board, a contacting portion and a soldering portion extending from two opposite ends of the base portion, respectively, the contacting portion stretching out of a top surface of the base board for being against the top board of the shell and the soldering portion stretching out of the base board; wherein two opposite ends of the base board extend upward to form a pair of sidewalls, an outside surface of each of the sidewalls defines two L-shaped locking fillisters, two opposite ends of the top board of the shell extend downward to form a pair of sideboards, each of the sideboards defines two openings, a top edge of one of the openings extends downward and then is bent inward to form a hook, a side edge of the other opening extends and then is arched inward to form a buckling portion, when the shell is closed, the hook and the buckling portion are buckled into a level part of the corresponding locking fillisters, respectively.

2. The connector as claimed in claim 1, wherein two ends of the top surface of the base board protrude upward to form two separating boards parallel to each other, the electric terminals are disposed between the separating boards, the ground terminals have two which are disposed in the base board and adjacent to an outside of the corresponding separating boards.

3. The connector as claimed in claim 2, wherein each of the separating boards defines an inserting notch, two ends of the top board of the shell define a window respectively, two inner edges of the two windows extend oppositely, then are bent downward and extend face-to-face to form a pair of fixing portions for clipping the flexible printed circuit board therebetween, when the shell is closed, the fixing portion is positioned in the corresponding inserting notch and the flexible printed circuit board is further located between the two separating boards.

4. The connector as claimed in claim 3, wherein one edge of the top board of the shell extends downward to form a preventing board extending longwise for holding the flexible printed circuit board.

5. The connector as claimed in claim 1, wherein the locking fillister for fastening the corresponding buckling portion therein defines a semi-pillared preventing bump therein extending vertically for holding the corresponding buckling portion.

6. A connector adapted for receiving a flexible printed circuit board therein, comprising:

an insulating housing having a base board, two ends of a top surface of the base board protrude upward to form two separating boards parallel to each other and each of the separating boards having an inserting notch formed therein;

a plurality of electric terminals disposed in the base board of the insulating housing between the separating boards for electrically contacting the flexible printed circuit board;

a shell pivoted onto the insulating housing and having a top board, the top board protruding downward to form at least one connecting rib capable of electrically abutting against the flexible printed circuit board, two ends of the top board of the shell respectively define a window, two inner edges of the two windows extend oppositely and are bent downward to extend in face-to-face relationship to form a pair of fixing portions for clipping the flexible printed circuit board therebetween, when the shell is closed, the fixing portion is positioned in a corresponding inserting notch and the flexible printed circuit board is further located between the two separating boards; and at least two ground terminals disposed in the insulating housing adjacent to an outside of the corresponding separating boards, each ground terminal having a base portion fastened in the base board, a contacting portion and a soldering portion extending from two opposite ends of the base portion, respectively, the soldering portion stretching out of the base board for being soldered with an outer printed circuit board, the contacting portion stretching out of the top surface of the base board for being electrically against the top board of the shell when the shell is turned onto the insulating housing so as to transmit out electromagnetic interference generated between the electric terminals and the flexible printed circuit board by means of the shell and the ground terminal.

7. The connector as claimed in claim 6, wherein one edge of the top board of the shell extends downward to form a preventing board extending longwise for holding the flexible printed circuit board.

8. The connector as claimed in claim 6, wherein two opposite ends of the base board extend upward to form a pair of sidewalls, an outside surface of each of the sidewalls defines two L-shaped locking fillisters, two opposite ends of the top board of the shell extend downward to form a pair of sideboards, each of the sideboards defines two openings, a top edge of one of the openings extends downward and then is bent inward to form a hook, a side edge of the other opening extends and then is arched inward to form a buckling portion, when the shell is closed, the hook and the buckling portion are buckled into a level part of the corresponding locking fillisters, respectively.

9. The connector as claimed in claim 8, wherein the locking fillister for fastening the corresponding buckling portion therein defines a semi-pillared preventing bump therein extending vertically for holding the corresponding buckling portion.

* * * * *